United States Patent [19]

Snyder et al.

[11] Patent Number: 4,660,733

[45] Date of Patent: Apr. 28, 1987

[54] CONE BOTTOM TANK AND LIFTABLE TANK SUPPORT

[75] Inventors: Larry L. Snyder; Lavelle H. Hansen; Richard Florer, all of Lincoln, Nebr.

[73] Assignee: Snyder Industries, Inc., Lincoln, Nebr.

[21] Appl. No.: 626,464

[22] Filed: Jun. 29, 1984

Related U.S. Application Data

[63] Continuation of Ser. No. 271,410, Jun. 8, 1981, abandoned.

[51] Int. Cl.[4] ..... B65D 6/34

[52] U.S. Cl. ..... 220/69; 220/71; 222/185

[58] Field of Search ..... 222/184, 185, 173, 143, 222/466, 461; 220/69, 71, 68, 1.5 R; 141/331, 339; 206/587, 591, 592, 968; 248/148, 146, 346, 158.1

[56] References Cited

U.S. PATENT DOCUMENTS

| | | | |
|---|---|---|---|
| 2,473,474 | 6/1949 | Keane | 222/185 |
| 3,122,276 | 2/1964 | Andrae | 222/184 |
| 3,318,473 | 5/1967 | Jones et al. | 222/185 |
| 3,319,834 | 5/1967 | Steele | 222/185 |
| 3,602,400 | 8/1971 | Cooke | 222/185 |
| 3,840,141 | 10/1974 | Allom et al. | 220/69 |
| 4,240,565 | 12/1980 | Croley | 222/105 |
| 4,344,645 | 8/1982 | Kirk | 220/69 |

*Primary Examiner*—Joseph J. Rolla
*Assistant Examiner*—Kenneth Noland
*Attorney, Agent, or Firm*—Banner, Birch, McKie & Beckett

[57] ABSTRACT

A three-piece tank assembly including a tank, a support base, and a support liner. The tank has a conical bottom with a discharge conduit at its apex; a longitudinally corrugated antisplash filling trough integrally formed with a sidewall of the tank; and an integrally formed cover including a bunghole for providing access to the filling trough. The discharge conduit may include a flow valve and check valve. The base includes a sidewall for nesting engagement with the tank sidewall, a flat ground-engaging surface and transverse longitudinal slots for receiving the forks of a forklift. The support liner has an upstanding wall and a conical top wall for supporting the conical bottom of the tank and nesting within the support base. Mating projections and grooves in the tank and support base prevent relative movement of the three elements of the tank assembly. Each of the three elements is rotationally molded of cross-linked, high density polyethylene. Also disclosed is a method of forming an open-ended, inwardly projecting tubular member, or an open-ended outwardly projecting conduit, with or without a flange at its distal end, in a molded container.

17 Claims, 8 Drawing Figures

CONE BOTTOM TANK AND LIFTABLE TANK SUPPORT

This application is a continuation of application Ser. No. 271,410, filed June 8, 1981 now abandoned.

BACKGROUND OF THE INVENTION

1. Field of the Invention

The present invention relates to bulk chemical storage tanks and, more particularly, to a transportable bulk chemical storage tank and tank support assembly.

2. Description of the Prior Art

The transport and storage of hazardous and corrosive materials for industrial use pose serious safety and economic problems. The chemical manufacturer typically packages his product in standard 55-gallon steel drums. For chemicals which are corrosive to metals, costly plastic liners are required for these drums. More recently, all-plastic industrial drums of comparable size have become widely accepted for storing and transporting such chemicals. Smaller disposable plastic containers also are used for storing and shipping these chemicals.

The relatively small capacity of all such drums increases the difficulties attendant to handling hazardous and corrosive chemicals. Small containers require more frequent filling and emptying, increasing the risk of spills in direct proportion. Use of small containers requires a greater number of containers, increasing cost and the risk of cross-contamination during filling or use, as well as the risk of mislabeling. Handling costs are also increased since a greater number of containers must be moved between manufacturer and user, and between the user's warehouse and ultimate work station.

In some applications such containers may be used only once. Disposal of a larger number of relatively small containers increases the serious environmental and health risks encountered in disposal of hazardous waste. In addition, the entire cost of the container must be allocated to its one-use capacity, and therefore fully reflected in the price of the chemical.

In other applications, such containers are reused until they are no longer serviceable. Even in this case, relatively small containers require substantially higher handling costs. They must be handled more frequently during both their initial journey from manufacturer to user, and their return journey from user to manufacturer.

Attempts have been made to overcome the problems inherent in the use of drums and containers by transporting and storing chemicals in recyclable bulk tanks having capacities on the order of several hundred gallons. Typically, the industrial user will "break the bulk" of such a tank by withdrawing from it only so much chemical as is needed at any one instant. When empty, the bulk tank is returned to the chemical manufacturer to be refilled. Currently available bulk tanks, however, are unwieldly and difficult to handle using conventional handling equipment, are not easily or safely drained, and allow deleterious aeration or foaming of the chemical to occur by splashing within the tank as it is filled.

SUMMARY OF THE INVENTION

Accordingly, it is an object of the present invention to provide a durable and corrosion-resistant bulk chemical storage and transport tank which is economical to manufacture and is easily handled by conventional handling equipment.

Another object of the invention is to provide such a tank which is designed for easy and safe withdrawal of its contents.

Another object of the invention is to provide such a tank which is designed to minimize internal splashing of the contents as the tank is filled.

Another object of the invention is to provide a cone-bottom tank having a bottom discharge outlet and a ground-engaging support which is adapted to be engaged by the forks of a forklift.

Another object of the invention is to provide an assembly including separate and interchangeable tank and tank support components.

Another object of the invention is to provide such an assembly wherein the tank and tank support components are individually made of rotationally molded, high-density cross-linked polyolefin material.

Another object of the invention is to provide a method of molding a plastic container with an open-ended hollow tubular member integrally connected thereto, such as a discharge conduit.

These and other objects are achieved by providing a tank assembly comprising a tank having an upstanding sidewall, and a downwardly sloped and inwardly converging bottom wall joined to the sidewall; and a support base beneath and engaging the tank to support the tank in an upright position, the base having a lower ground engaging surface and forklift engaging means adapted to receive the forks of a forklift so that the tank assembly can be lifted and transported.

The assembly may include a support insert adapted to be supported on an upper surface of the base, and a sloped upper surface adapted to mate with the bottom wall of the tank to support the tank on the base.

The invention also encompasses a tank having an upstanding sidewall, a bottom wall, and an antisplash filling trough extending from the upper portion of the tank to the lower portion thereof near the bottom wall immediately adjacent the sidewall. Preferably, the filling trough comprises a longitudinally corrugated integral portion of the tank sidewall.

The invention further encompasses a method of forming a plastic container having an open-ended hollow tubular member integrally connected to the container and communicating with its interior, comprising the steps of molding the container and member of plastic material in a closed mold having the desired container and member shape to produce a container preform having a communicating hollow tubular member with a closed distal end, removing the container preform from the mold, and removing a portion of the hollow tubular member at its distal end to form an opening therein.

The invention may be best understood by referring to the following detailed description and accompanying drawings which illustrate the invention.

DETAILED DESCRIPTION OF THE PREFERRED EMBODIMENTS

Figure 1:
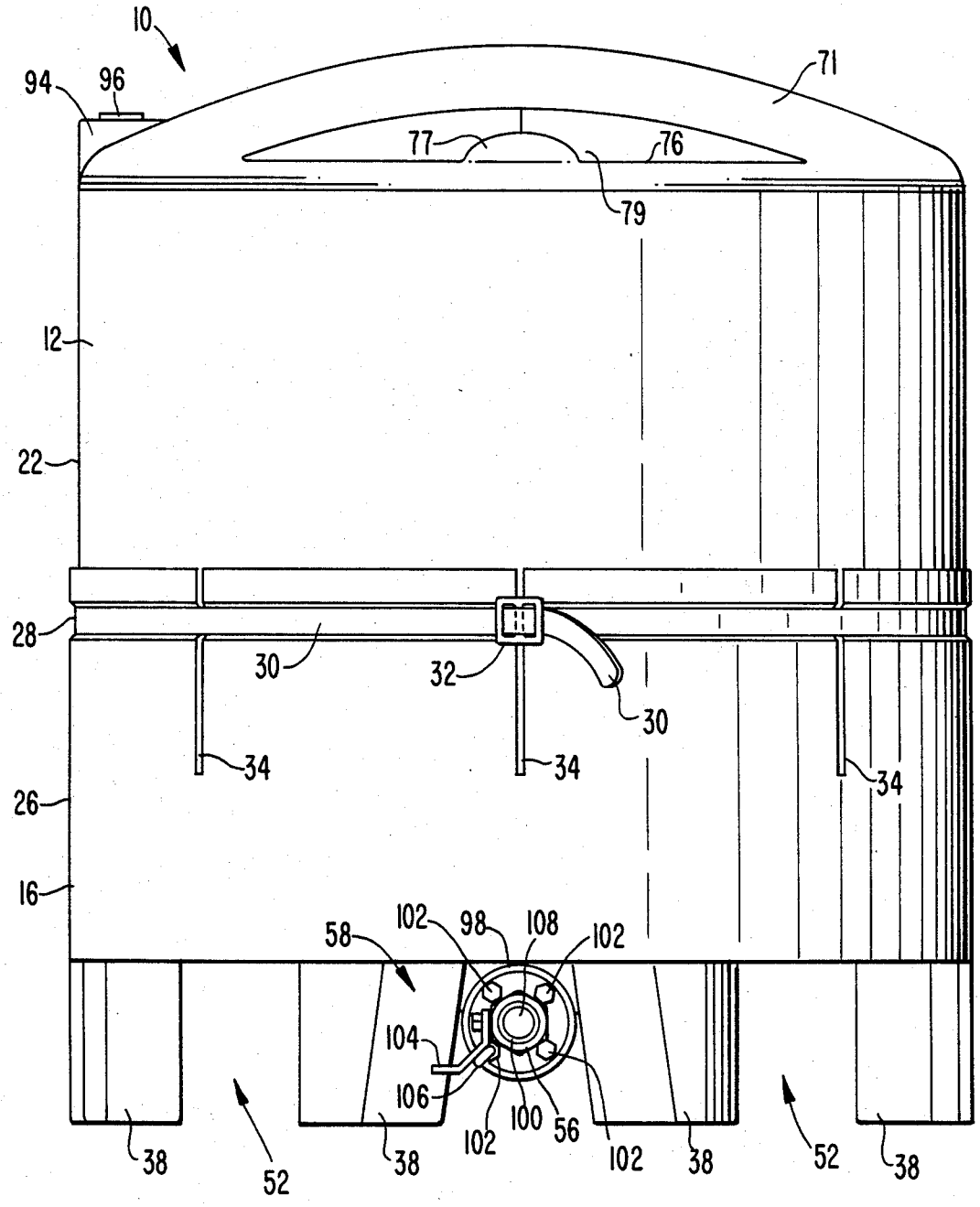
FIG. 1 is a front elevational view of a tank assembly in accordance with the present invention.
Figure 4:
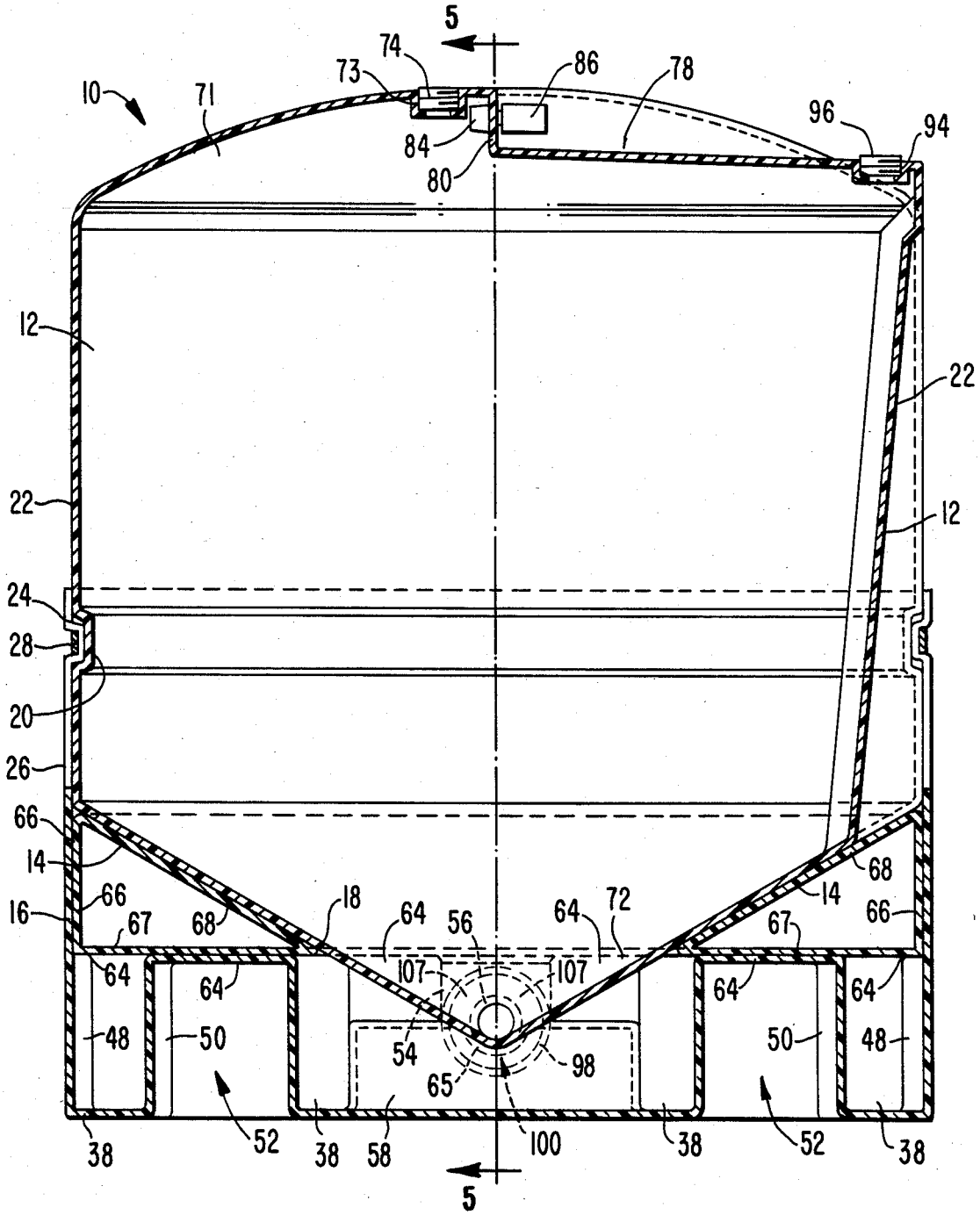
FIG. 4 is a cross-sectional view of the same taken along line 4—4 of FIG. 2.
Figure 5:
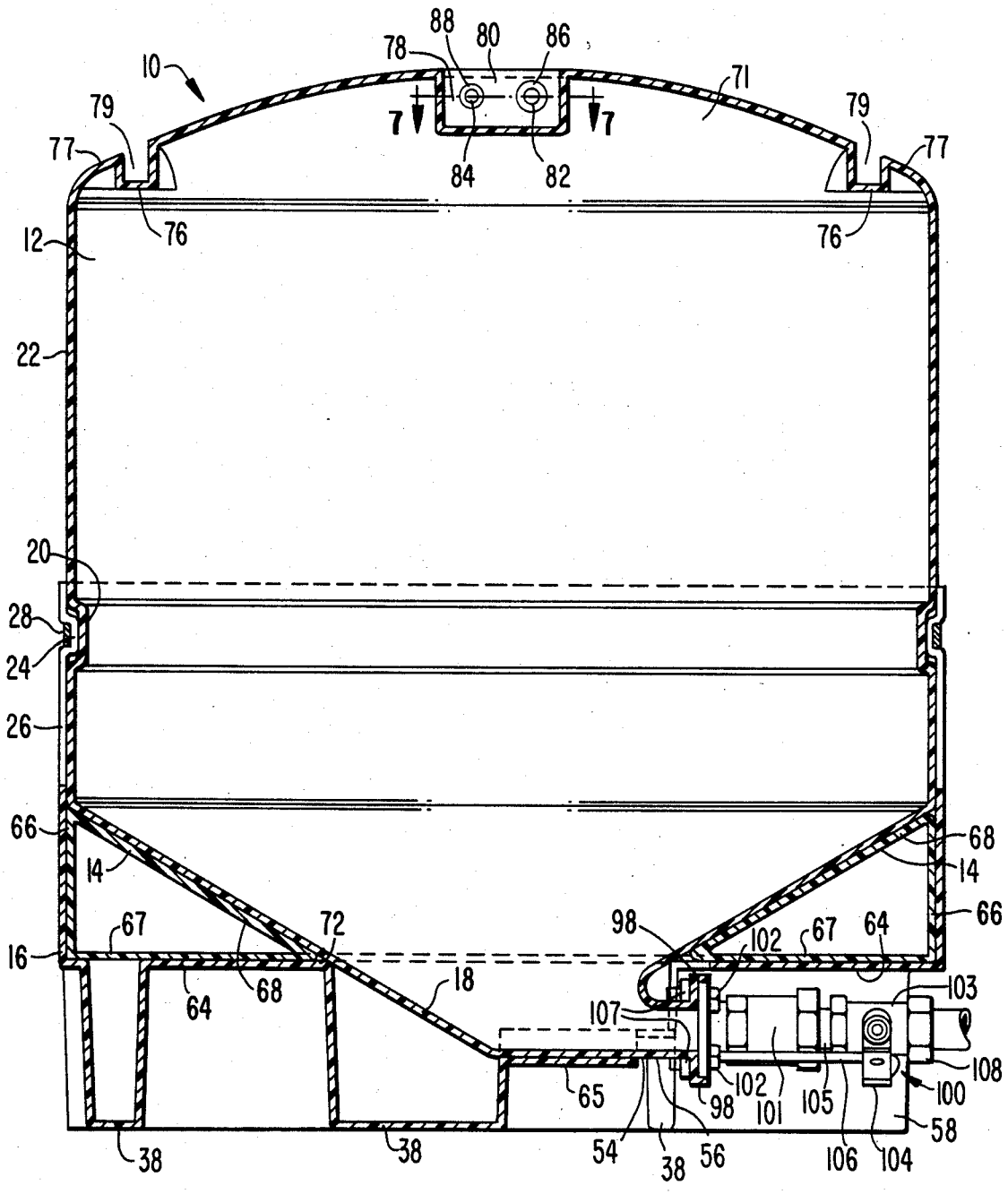
FIG. 5 is a cross-sectional view of the same taken along line 5—5 of FIG. 4.

Referring to FIGS. 1, 4 and 5, the tank assembly 10 according to the invention includes a tank 12 having a conical bottom wall 18, a support liner 14, and a support base 16. Support base 16 rests on a supporting surface such as a floor. Support liner 14 nests within support base 16 for supporting conical bottom wall 18 of tank 12.

The elements of the tank assembly 10 may be conveniently assembled and secured together, or disassembled for cleaning, repair or parts replacement. Referring to FIGS. 4 and 5, tank 12 includes a groove 20 in sidewall 22 extending about the perimeter of tank 12, which engages a mating, inwardly projecting rib 24 in sidewall 26 of support base 16. Rib 24 is in registry with a groove 28 on the outer surface of base sidewall 26. A flexible band 30 may be secured about tank 12 in base groove 28 by a suitable fastener such as buckle 32. Band 30 may be a steel, nylon or plastic band or cloth, plastic webbing or any other convenient and suitable material. Vertical slots 34 (FIG. 1) may be cut into the upper portion of base sidewall 26 to allow sidewall 26 to flex when tank 12 is inserted into or removed from base 16. Tank 12 is therefore firmly secured in base 16 by engagement of rib 24 and groove 20 upon tightening of band 30. Tank 12 may be released from base 16 by simply loosening band 30 and spreading split sidewall 26 of base 16.

Figure 3:
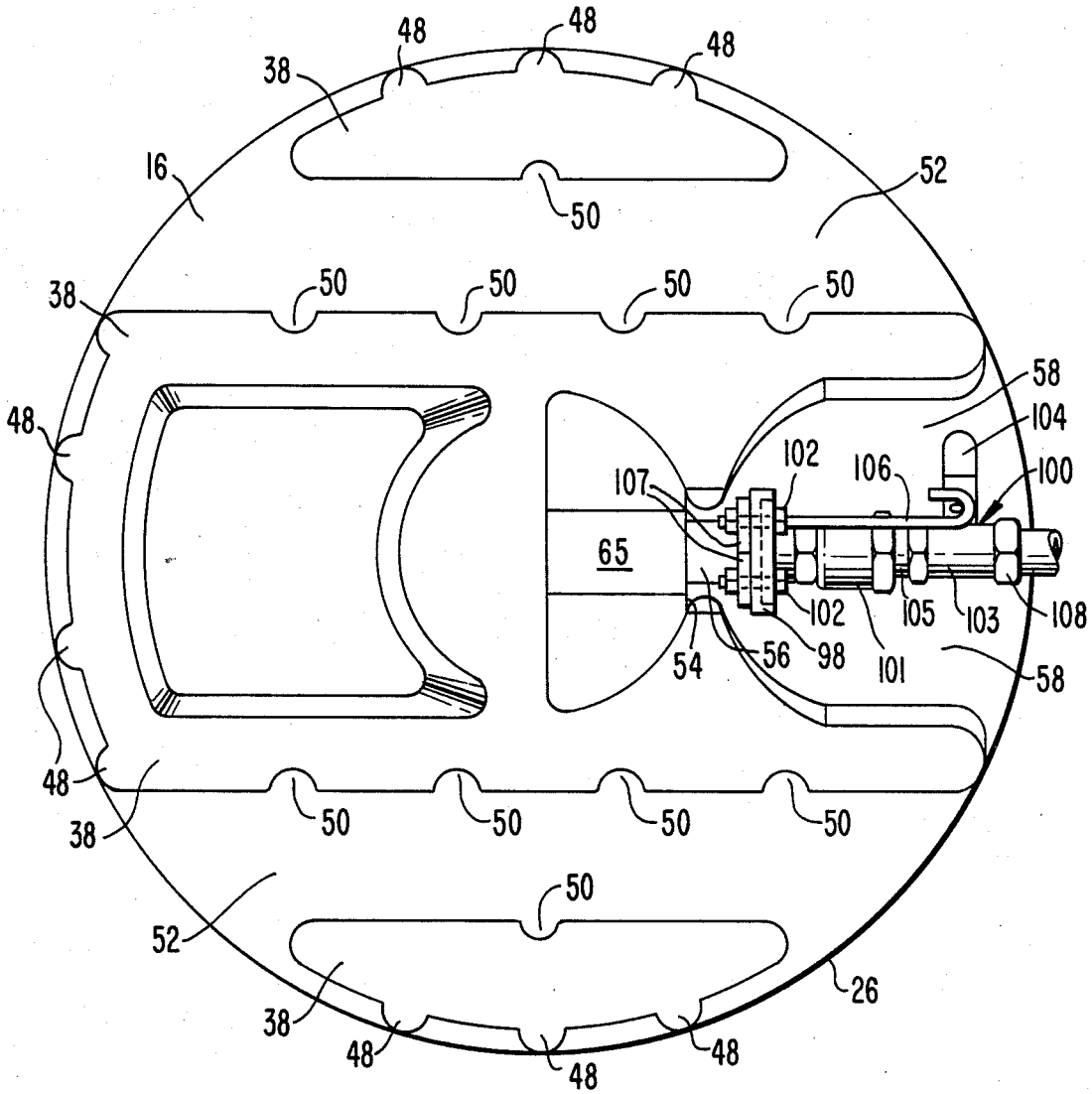
FIG. 3 is a bottom plan view of the same.

Cylindrical upstanding sidewall 26 of base 16 forms a shell which extends downwardly to support pads 38 forming a substantially flat ground engaging surface for supporting the tank assembly in a stable condition. Support pads 38 include convex reinforcing ribs 48 and concave reinforcing ribs 50 (FIG. 3). Two parallel transverse slots 52 extend across the bottom of the support base 16 and are adapted to receive the forks of a conventional forklift for lifting and transporting tank assembly 10. Opening 54 in support base 16 receives the discharge conduit 56 of tank 12 which nests in an elevated cradle 65 in support base 16 (FIGS. 4 and 5). A lateral curved recess 58 adjacent opening 54 affords easy access to discharge conduit 56. The interior of support base 16 has a series of substantially flat supporting surfaces 64 interconnecting the sidewalls of support pads 38. Surfaces 64 are adapted to support intermediate support liner 14.

Figure 6:
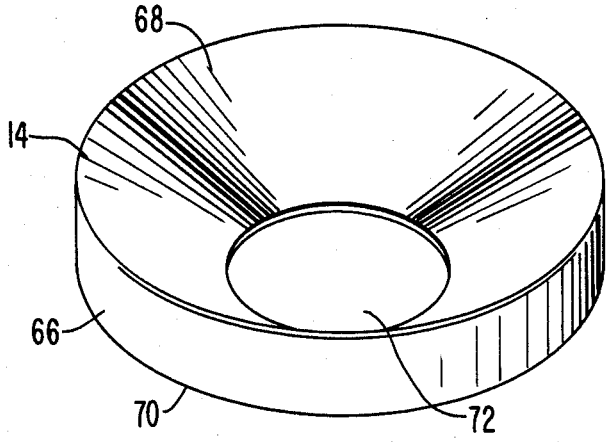
FIG. 6 is a perspective view of the support insert of the tank assembly.

Referring to FIG. 6, support liner 14 is a hollow, doughnut-shaped element which includes an upstanding cylindrical sidewall 66, a flat bottom wall 67 adapted to rest on supporting surfaces 64 of base 16, and a downwardly sloped and inwardly converging top wall 68, terminating in a circular aperture 72 for receiving the lower portion of conical bottom wall 18 and discharge conduit 56 of tank 12. Conical bottom wall 18 of tank 12 mates with top wall 68 of support liner 14 so that the weight of tank 12 and its contents is well distributed across supporting surfaces 64 of base 16.

Figure 2:
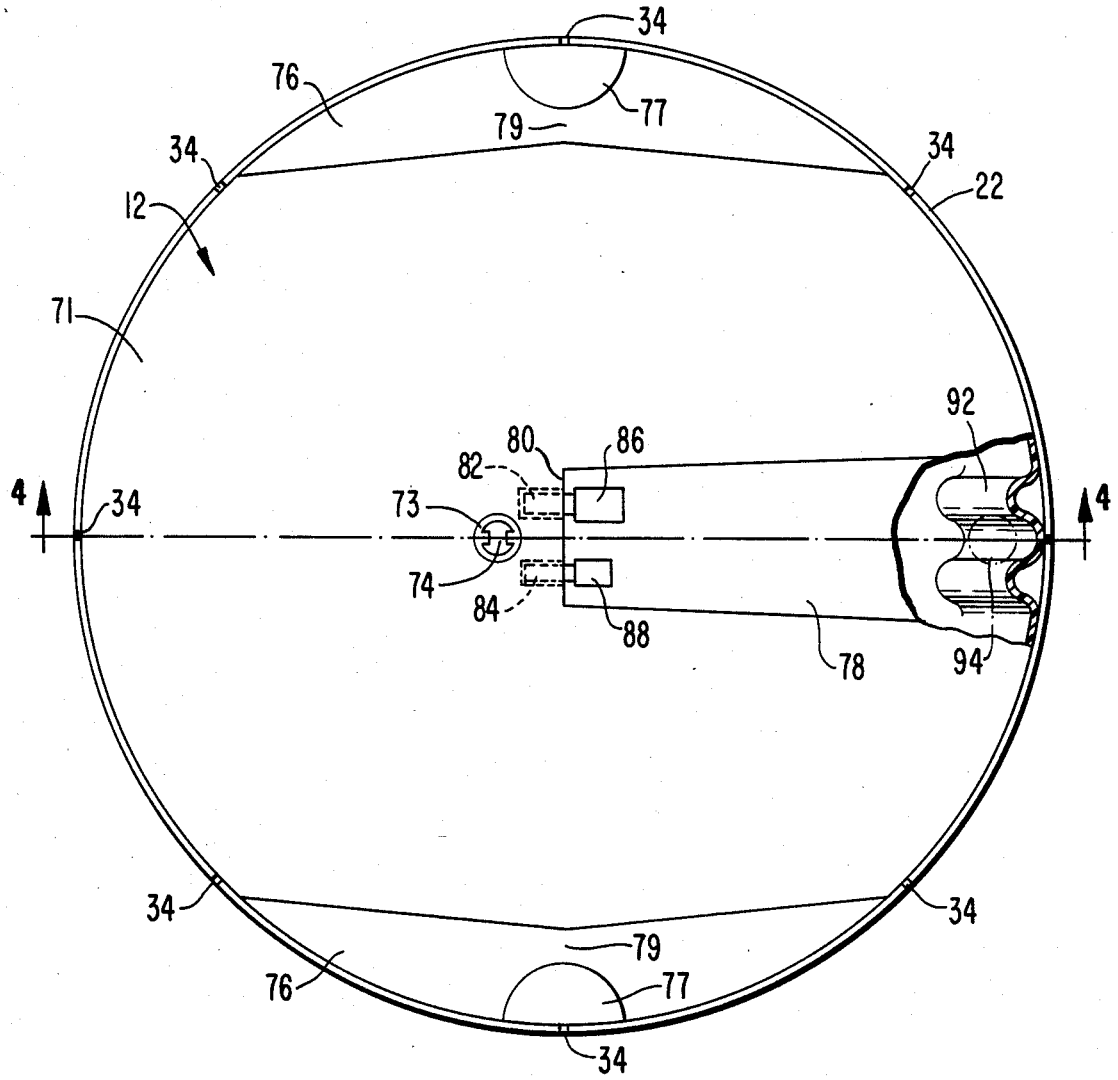
FIG. 2 is a top plan view of the same, partly in section.

Referring to FIG. 2, tank 12 includes an integral dome-shaped cover 71 having a bunghole 73 near its center for receiving a threaded bung 74. Bunghole 73 provides direct access to the interior of the tank for cleaning and inspection. Cover 71 includes two diametrically opposed depressed shoulders 76, each of which includes a raised boss 77 at its outer edge. Shoulders 76 and bosses 77 cooperate to define tie-down channels 79 adapted to receive tie-down straps to hold the tank assembly fast during transport. A central elongated recess 78 in cover 71 provides an indented vertical surface 80 having open-ended hollow tubular members 82, 84 projecting into and communicating with the interior of tank 12. Tubular members 82, 84 are tapped with female threads. Positive pressure relief valve 86 having a male threaded end is screwed into tubular member 82. Vent valve 88 having male threads is screwed into tubular member 84. These threaded connections may be sealed with an appropriate sealant. In the preferred embodiment, positive pressure relief valve 86 is set to open to relieve excess pressure within the tank when the internal pressure reaches approximately 3 psig, and vent valve 88 is set to open when the pressure within the tank reaches approximately −1 psig to permit air to enter the tank to replace the volume of material discharged through discharge conduit 56.

Referring to FIGS. 2 and 4, sidewall 22 of tank 12 is generally cylindrical and includes an integrally formed, longitudinally corrugated, inclined antisplash filling trough 92. Filling trough 92 extends from cover 71 to a point along conical bottom wall 18 of tank 12 near the bottom of sidewall 22. A threaded bunghole 94, sealable by a threaded bung 96, provides direct access to filling trough 92 for filling tank 12. Filling trough 92 minimizes splashing and entraining of air during filling by permitting the material to flow smoothly down along the trough surface.

Bottom wall 18 of tank 12 is preferably formed as a right circular cone having a base diameter equal to the diameter of cylindrical sidewall 22. Sidewall 22 and bottom wall 18 may alternatively have matching cross-sections which are polygonal, rather than circular. Of course, base 16 would have to have a similar polygonal shape.

Referring to FIGS. 3 and 5, discharge conduit 56 is integrally formed with tank 12 and includes a flange 98 for mounting a flow and check valve assembly 100 with fasteners such as nut and bolt fasteners 102 which pass through apertures in flange 98 and in a split two-piece metallic reinforcing flange 107 placed behind flange 98 and surrounding discharge conduit 56. Valve assembly 100 includes a conventional ball check valve 101 which is bolted to flange 98, and a conventional on-off flow valve 103 threadably supported at 105 on check valve 101. A handle 104 on flow valve 103 can be turned to start, stop or regulate discharge of material from tank 12 through discharge conduit 56. Check valve 101 prevents the back flow of material through discharge conduit 56 into tank 12. Flow valve 104 may be conveniently locked in the off position by securing a padlock, not shown, about valve handle 104 and elongated, J-shaped locking stud 106, which serves also as a fastener 102. Flow valve 103 terminates at its distal end in a female threaded pipe fitting 108 for threadable attachment of a discharge pipe to convey the material to the point of use. Other types of valve assemblies, fasteners, and discharge couplings may be used.

The basic elements of tank assembly 10, i.e., tank 12, support liner 14, and support base 16, may be conveniently made from the same material, such as metal or plastic. In the preferred embodiment, however, tank 12, support liner 14, and support base 16 are rotationally molded of cross-linked, high density polyethylene or other polyolefin. Rotational molding techniques are preferred because they yield a high quality, high strength product at reasonable cost. In addition, rotational molding desirably produces walls of substantially uniform thickness. Examples of rotational molding techniques that result in hollow articles having substantially uniform wall thickness are found in U.S. Pat. Nos. 3,970,736; 3,976,821; 4,029,729 and 4,257,527. In practice it has been found that a tank 12 having a capacity of approximately 200 gallons and an approximate wall thickness of 0.130 to 0.200 inches is suitable for a wide variety of industrial applications. For such a tank a support liner 14 having a wall thickness of approximately 0.190 inches, and a support base 16 having a wall thickness of approximately 0.190 to 0.250 inches, have been found suitable. Tanks having capacities of 300 or 500 gallons may be manufactured according to the present invention. Such larger tanks are taller and require correspondingly thicker walls.

The presesnt invention also relates to a method of forming a hollow plastic article, such as a container, with an integral open-ended hollow tubular member communicating with the container interior. The open-ended tubular member may project outwardly of the container, or inwardly into the container. In addition, an outwardly projecting open-ended hollow tubular member having a transverse flange surrounding its distal end may be produced according to this method. Rotational molding is the preferred molding method, although blow molding and other techniques may also be employed.

Figure 8:
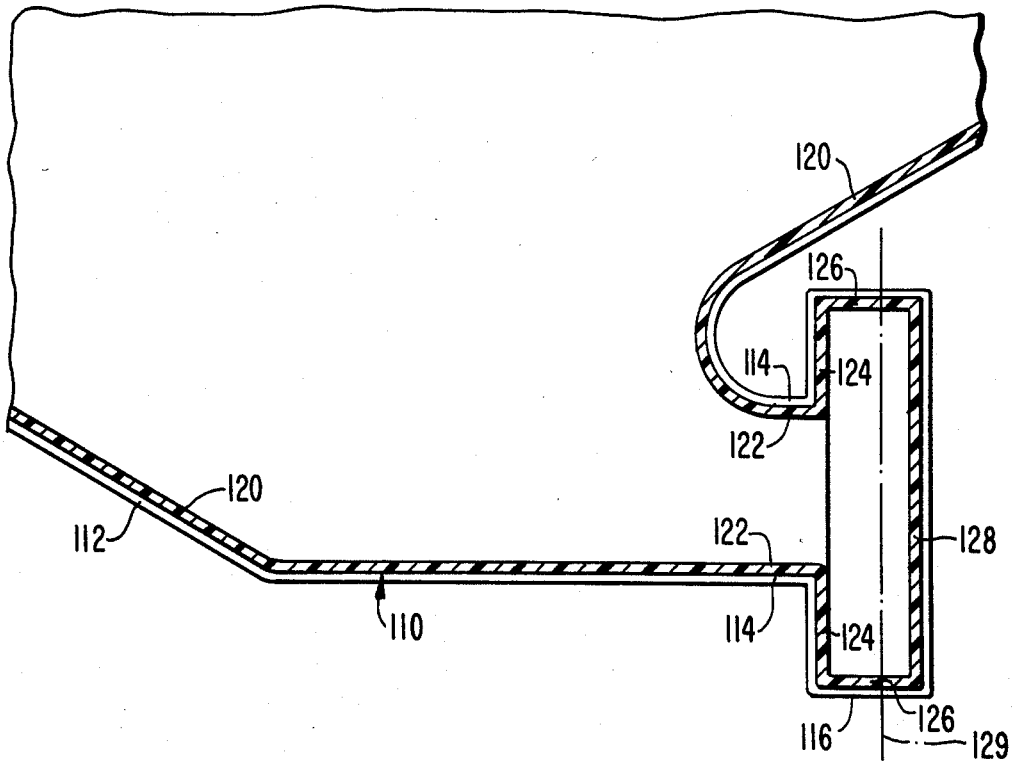
FIG. 8 is a cross-sectional view of another portion of the tank in a mold.

Referring to FIG. 8, one-half of a closed mold 110 is shown having the desired container and member shape to produce a container preform having a communicating hollow tubular member with a closed distal end. Mold 110 includes a container body-forming portion 112, a tube-forming portion 114, and a closed-ended flange-forming portion 116. The tube-forming portion 114 of mold 110 has an inside cross-section equal to the outside cross-section of the tubular member to be formed. The inner cross-section of the tubular member is determined by the desired wall thickness, which in rotational molding is a function of the total surface area of the mold and the amount of molding material charged into the mold.

After molding, the container preform is removed from the mold. The container preform has a body 120, a hollow tube 122, a transverse flange 124 with a longitudinal lip 126, and a severable closed distal end 128. Severable portion 128 of the preform is removed from lip 126 by any convenient method, such as shearing, sawing, or heat cutting along plane 129, resulting in an open-ended, hollow, flanged tubular member integrally connected to and projecting from the container body. Tubular member 122 may be produced either with or without flange 124, and may be subsequently worked as desirable. For example, open-ended tubular member 122 may be tapped with male or female threads, not shown, or flange 124 may be drilled to include holes for attachment of a valve assembly 100 as illustrated in FIGS. 1 and 5.

Figure 7:
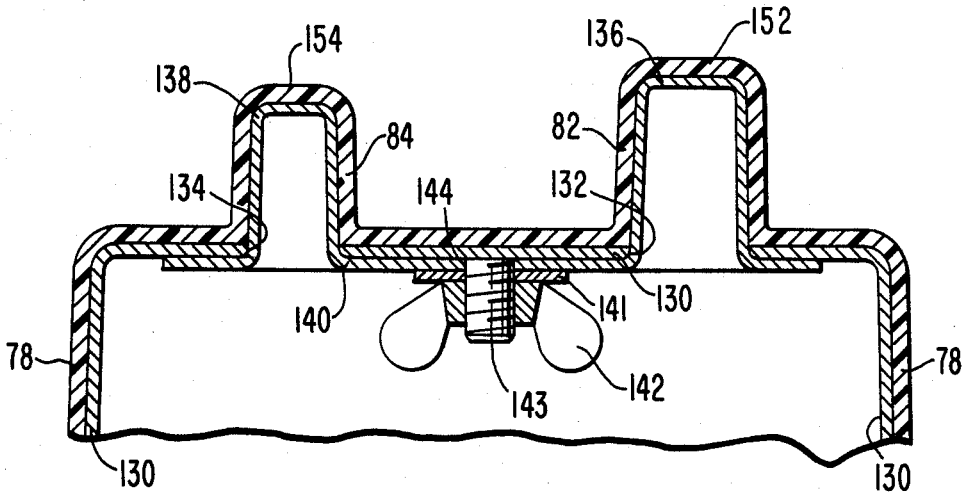
FIG. 7 is a cross-sectional view of a portion of the tank in a mold.

FIG. 7 is a longitudinal cross-sectional view of tank 12 in a mold through central recess 78 and tubular members 82, 84, taken generally along line 7—7 in FIG. 5. The method of the present invention also permits formation of inwardly projecting tubular members in a rotationally molded container such as members 82 and 84 of FIGS. 2, 4 and 5. The method includes the step of molding a container in a mold body 130 having apertures 132, 134 aligned with the longitudinal axis of the tubular members to be formed. Closed ended male members 136, 138 carried by mold insert 140 are inserted into apertures 132, 134, respectively, to close apertures 132, 134. Mold insert 140 is secured to mold body 130 by a threaded stud 133 secured to mold 130, received in an aperture 144 in mold insert 140 and clamped by a washer 141 and a wing nut 142. Male members 136, 138 have external dimensions that match the desired interior dimensions of the tubular members to be formed.

With mold insert 140 secured in place, mold 130 is charged with plastic material. If rotational molding is performed, mold 130 is rotated and heated to mold the container, which includes deposition of plastic material on the surfaces of male members 136, 138 to form inwardly projecting, closed-ended tubular members 82, 84. The container preform is removed from the mold and mold insert 140 is removed from mold body 130. A portion of the distal closed end 152, 154 respectively of inwardly projecting tubular members 82, 84 is removed by drilling through the tubular members from outside the container.

In a preferred embodiment, tubular members 82, 84 are cylindrical. Preferably, following the step of drilling out closed ends 152, 154, tubular members 82, 84 are tapped with female threads, not shown, on their interior surfaces.

While the preferred embodiments of the invention have been illustrated and described, it is to be understood that these are capable of variation and modification by those skilled in the art and that the scope of the invention is not limited to the precise details set forth, but should be determined by the following claims.

What is claimed is:

1. A molded plastic tank assembly comprising:

a removable molded plastic tank having an upstanding sidewall, a downwardly sloped and inwardly converging bottom wall joined to said sidewall, and an outlet adjacent the lowest portion of said bottom wall;

a molded plastic support base having a lower ground engaging surface, an upper portion for supporting said tank, and an upstanding base wall;

a removable molded plastic support insert having a bottom portion supported on the upper portion of said base, a sloped upper surface which mates with said bottom wall of said tank to removably support said tank on said support base, and an upstanding sidewall;

said base wall of said support base extending upwardly and overlapping both the sidewall of said tank and the sidewall of said support insert.

2. A tank assembly in accordance with claim 1 wherein said upstanding sidewall is cylindrical, and said bottom wall and said sloped upper surface are conical.

3. A tank assembly in accordance with claim 1 wherein said tank includes a cover.

4. A tank assembly in accordance with claim 3 wherein said cover is integral with said sidewall.

5. A tank assembly in accordance with claim 3 wherein said cover includes a vent valve for permitting air to enter said tank to replace the volume of fluid withdrawn from said tank during emptying when negative air pressure within said tank decreases below a predetermined threshold.

6. A tank in accordance with claim 3 wherein said cover includes a positive pressure relief valve for venting positive pressure within said tank when said positive pressure increases above a predetermined threshold.

7. A tank assembly in accordance with claim 3 wherein said cover includes a bunghole for providing direct access to the interior of said tank, and said bunghole is sealable by a bung.

8. A tank assembly in accordance with claim 7 wherein said bunghole includes threads for threadably receiving a threaded bung.

9. A tank assembly in accordance with claim 1 wherein said base includes means adapted to be engaged by a lifting device for elevating and transporting the tank assembly.

10. A tank assembly in accordance with claim 9 wherein said lifting device engaging means includes parallel slots extending transversely across said base for receiving the forks of a forklift.

11. A tank assembly in accordance with claim 1 further comprising a discharge conduit connected to said outlet below the lowest portion of said bottom wall.

12. A tank assembly in accordance with claim 11 further comprising a discharge valve in said conduit for controlling the flow of material through said conduit.

13. A tank assembly in accordance with claim 12 further comprising a check valve in said conduit in series with said discharge valve for permitting the flow of material from said tank through said conduit, and for preventing the flow of material into said tank through said conduit.

14. A tank assembly in accordance with claim 1 wherein said tank and said support base include securing means for securing said tank, said support insert and said support base together as a unitary assembly.

15. A tank assembly in accordance with claim 14 wherein said securing means comprises said upstanding base wall and mating depressions and projections on said tank sidewall and said base wall for preventing relative movement of said tank and said support base.

16. A tank assembly in accordance with claim 15 wherein said securing means includes a tank groove in said tank sidewall extending about the perimeter of said tank, a mating projection on the inner surface of said base wall in registry with a base groove on the outer surface of said base wall, and a flexible element surrounding said base wall and seated in said base groove to releasably urge said projection into said tank groove.

17. A tank assembly in accordance with claim 1 wherein said tank, said support base, and said support insert are rotationally molded of cross-linked, high density polyethylene.

* * * * *